US007634222B2

(12) United States Patent
Kuo

(10) Patent No.: US 7,634,222 B2
(45) Date of Patent: Dec. 15, 2009

(54) OIL DISPENSER FOR SIMPLEX AND DUPLEX PRINT ENGINE

(75) Inventor: Youti Kuo, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 519 days.

(21) Appl. No.: 11/500,591

(22) Filed: Aug. 8, 2006

(65) Prior Publication Data

US 2008/0035002 A1 Feb. 14, 2008

(51) Int. Cl.
*G03G 15/00* (2006.01)

(52) U.S. Cl. ..... 399/407; 399/320; 399/325

(58) Field of Classification Search ..... 399/320, 399/322, 323, 324, 326, 381, 388, 390, 397, 399/400, 401, 402, 407
See application file for complete search history.

(56) References Cited

U.S. PATENT DOCUMENTS 2,297,691 A 10/1942 Carlson
4,182,263 A 1/1980 Naeser et al.
4,309,957 A 1/1982 Swift
4,359,963 A 11/1982 Saito et al.
5,113,223 A 5/1992 Theodoulou
5,436,711 A * 7/1995 Hauser ..... 399/328
5,708,919 A * 1/1998 Yamada et al. ..... 399/67
5,987,293 A * 11/1999 Diels ..... 399/325
6,032,016 A * 2/2000 Morigami et al. ..... 399/325
6,263,182 B1 7/2001 Baker
6,321,650 B1 11/2001 Ogawa et al.
6,775,508 B2 * 8/2004 Macht et al. ..... 399/327

* cited by examiner

*Primary Examiner*—David M Gray
*Assistant Examiner*—Benjamin Schmitt
(74) *Attorney, Agent, or Firm*—James J. Ralabate

(57) ABSTRACT

This is a mechanical oil dispenser for use in applying an oil to the surface (or two surfaces in a duplex mode) of printed media to improve its sheet-handling characteristics. This dispenser system has an oil-containing housing or tank with oil ports at the bottom of the tank. The ports are abutting a wick, this wick then disperses oil to an applicator roll which in turn applies oil to one or both surfaces of a printed media. The oil ports and oil flow are controlled by the profile of a cam and shaft in operative connection to said ports. Opening and closing of these oil ports are controlled by a cam shaft movement actuated by the rotation and stopping of the applicator roll.

8 Claims, 5 Drawing Sheets

OIL DISPENSER FOR SIMPLEX AND DUPLEX PRINT ENGINE

FIELD

This invention relates to an electrophotographic marking process and, more specifically, to continuous feed simplex and duplex electrophotographic marking systems.

BACKGROUND

In Xerography or an electrophotographic process, a uniform electrostatic charge is placed upon a photoreceptor surface. The charged surface is then exposed to a light image of an original to selectively dissipate the charge to form a latent electrostatic image of the input document. The latent image is developed by depositing finely divided and charged particles of toner upon the photoreceptor surface. The charged toner is electrostatically attached to the latent electrostatic image areas to create a visible replica of the input document. The developed image is then usually transferred from the photoreceptor surface to a final support material such as paper and the toner image is fixed thereto to form a permanent record corresponding to the input document.

In a flash fusing Continuous Feed (CF) machine, toner images are prone to cause smudges and finisher contamination problems because of no release oil being applied to the imaged paper to lubricate the contact surfaces (rollers, belts, baffles) in a finisher equipment. The high frictional force causes the toner particles to break off from the marginally flash fused images. An effective solution is to apply lubricating oil, which is functionally similar to a release oil used in roll fusing having a contact nip for applying pressure, to the print sheet after the flash fusing process and before the sheet enters the finisher equipment. To apply lubricating oil an oil dispenser must be portable and retrofitable to an existing CF machine without using software control. For adaptive to a duplex CF printer, an oil dispenser must be able to apply oil to both sides of a sheet.

Flash fusing is a non-contact fusing technology that is widely used in continuous feed machines. It has advantages in wide range of substrate applications and in the transaction printing market. However, without having lubricating oil on the sheet, toner particles in the printed sheets could be easily rubbed off by rollers and belts in a high speed finisher and result in smudges on sheets and contamination problems in the finisher. To increase the fix performance of flash fusing, an effective solution is to apply lubricating oil or wax to the printed sheet after the flash fusing and before entering a finisher. By this means, the oiled sheet is lubricated as is the case for roll fusing that may prevent smudges and finisher contamination problems. A description of flash fusing is provided in U.S. Pat. No. 5,113,223 which is incorporated by reference herein.

This invention deals with an independent oil dispenser for applying oil to two sides of a printed sheet simultaneously. Prior to the description of the present invention, the following briefly describes the prior art patents and existing practice for comparisons. A conventional oil dispenser uses a wick for contacting an oil applicator then the applicator applies fluid to a fuser roll. A wick assembly generally includes two different layers. A first layer in contact with the surface of the fuser member meters precise amounts of release fluid thereon while a second layer in contact with the first layer and an oil reservoir has high release fluid retention capabilities for supplying the first layer with the fluid. In a preferred embodiment, the wick comprises a layer of Teflon which contacts the surface of a fuser roll and a second layer of Nomex which has its underside in contact with an applicator roll. As shown in U.S. Pat. No. 4,309,957 by Swift of Xerox Corporation, a wick is placed above an oil reservoir. This configuration is not directly suitable to an application that requires a wick be positioned at the bottom of the oil reservoir such as is the case for a duplex printer employing flash fusing where oil needs to be applied to both sides of a sheet after the flash fusing process. The Swift patent is concerned with applying release fluid to a fuser roll, not to an applicator roll.

For placing a wick at the bottom of an oil reservoir in a supply tank, U.S. Pat. No. 6,263,182 by Baker of Lexmark International uses piezo elements for moving a diaphragm for closing and opening oil ports to control oil flow by gravity to a wick pad. However, it requires software control to cycle the piezo elements to distribute oil after every predetermined recording sheet passes through the fuser. The system of Baker includes means for dispensing fluid onto a fuser roller and is part of the machine, not a unit like the present invention that can easily be retrofitted into an existing machine.

For reducing finisher contamination and smudges on printed sheets, a wax dispenser unit may be added at the exit of a Continuous Feed machine employing flash fusing. In the flash fusing system, no lubricating fluid is applied to the sheet at the fusing station. In such wax dispenser two dispensing units may be positioned in opposite direction for applying wax to both sides of a web sheet. Each dispensing unit uses a wax block for supplying wax to an applicator brush roll which is in contact with one side of the web sheet. The coating of wax, however, yields an undesirable waxy surface on the web sheet. Also, the wax dispenser uses an independent motor for controlling the applicator speed and the amount of wax on the sheet. An optimized wax rate, however, may require a brush speed that is different from the sheet speed that leads to brush abrading on the imaged sheet. For avoiding abrading on the imaged sheet, the speed of a lubricating oil applicator should be the same as the sheet speed and the dispensing rate should be independently adjustable. Typical continuous paper web feed units including those usable in the present invention are illustrated in U.S. Pat. No. 6,321,650.

SUMMARY

With limitations as described in the above exemplary background patents and practice, the present invention deals with an oil dispenser that has the following uniqueness and advantages: 1. in a duplex configuration using two identical oil-dispensing units for applying oil to both sides of the duplex sheet with and without nip force 2. gravity-fed oil flow into the wick, 3. stable oil rate controllable mechanically with a specifically shaped cam travel, 4. no abrading action on the sheet, and 5. units portable and adaptable to be retrofitted in existing print engine with use of machine drive of the host engine or with independent motor requiring no software interaction.

The present embodiments provide a mechanical fluid dispenser for use in applying an oil to the surface of printed media to improve its sheet-handling characteristics in finishing equipment. As above noted, the system of this invention can easily be retrofitted into existing marking equipment without any major changes. Any suitable provisions may be made to accomplish this retrofit. Also, as noted earlier, oil is needed for reducing frictional force by a flash fused print in the paper path of a finisher device. Flash fused print is susceptible to "smudge defects" due to frictional components in contact disturbing the images. The dispenser system in this invention consists of lubricating fluid in a tank, a mechanical cam actuated flow controlling valve and a wick for dispensing fluid onto an applicator roll. The applicator roll then contacts the surface of the sheet to be treated and applies the required amount of fluid. One advantage of this invention is not requiring any electrical connections into the control system of the host machine, hence it is easier to implement into existing systems. Silicon fluid and other oils useful in the present invention are disclosed in U.S. Pat. Nos. 4,182,263; 4,309,957 and 4,359,963. A typical lubricating oil useful in embodiments of the present invention is Silstar 3500 silicone oil available from Fuji Hunt Pressroom Chemical Co.

An oil-dispensing unit of the present invention uses a cam shaft and plunger assembly for controlling the opening and closing of oil ports by wrap-spring clutch actions. The oil is being gravity fed into a wick which is in contact with an applicator roll. The cam profile determines the flow channel gap, therefore, the oil rate at different stop limits of the clutch. For a duplex printer, two oil dispenser units can be integrated with an oil transfer roll for applying oil to both sides of the print sheet simultaneously. Optionally, two oil dispensing units may be positioned side by side for forming a drive nip with additional load for flattening toner images and enhancing the fix level.

DETAILED DESCRIPTION OF THE DRAWINGS AND PREFERRED EMBODIMENTS

Figure 1:
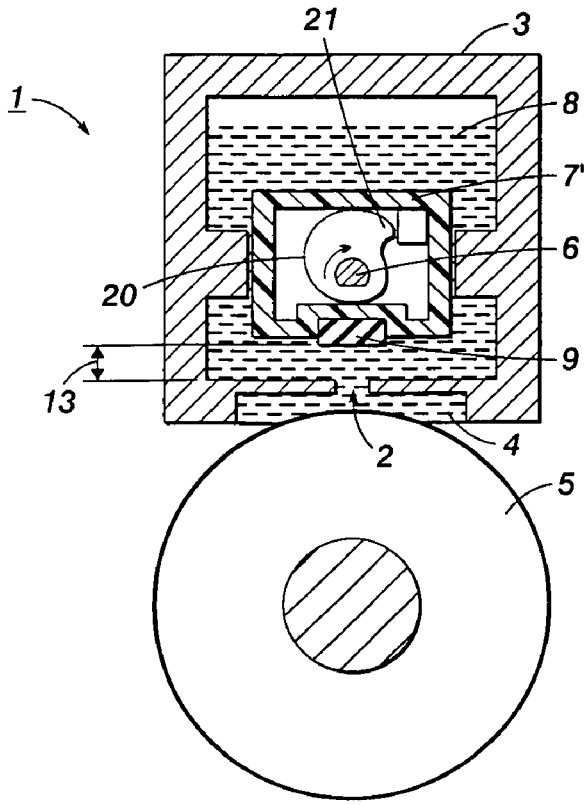
FIG. 1 illustrates a front view of a dispensing unit embodiment where the oil dispensing ports are open.
Figure 2:
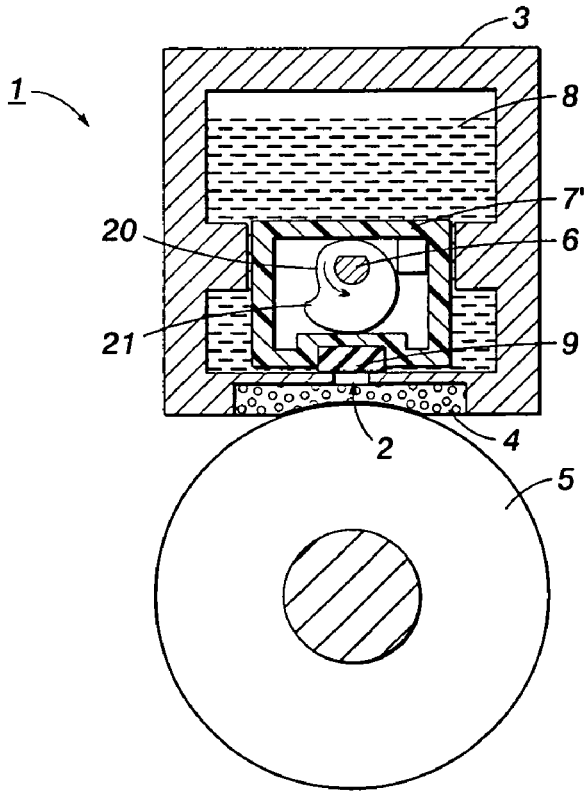
FIG. 2 illustrates a front view of a dispensing unit embodiment where the oil ports are closed.

In FIG. 1, a front view of an embodiment of a dispensing unit 1 of this invention is shown with oil ports 2 open. In FIG. 2, a front view of this embodiment is shown with oil ports 2 closed.

Figure 3:
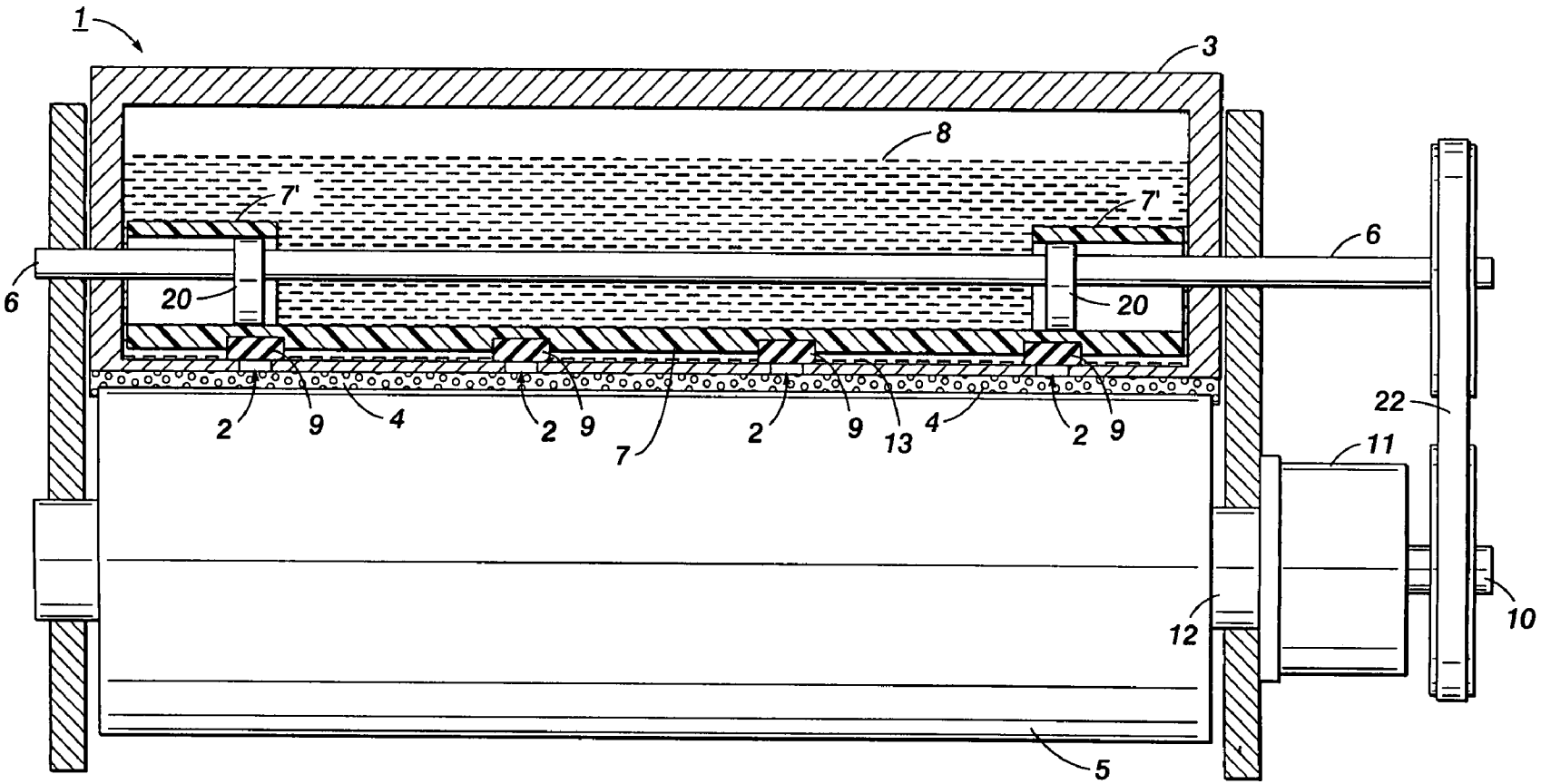
FIG. 3 illustrates a side view of a dispensing unit embodiment of the dispensing cam mechanism and wrap-spring clutch control.

An oil dispensing unit 1 of the present invention mainly consists of an oil tank 3, a wick 4, an applicator roll 5, a cam shaft 6 and plunger assembly 7 and a wrap-spring clutch 11 assembly as shown In FIG. 3. In FIG. 1, which is a front view, an oil tank 3 having a wick 4 at the bottom is mounted on top of an applicator roll 5. The wick 4 is saturated with lubricating oil 8 which is fed by gravity through an array of oil ports 2 distributed along the width and length of the wick 4. A wick 4 useful in the present invention is preferably made up of a layer of Teflon felt or fiber needled to a fibrous or felted Nomex material. The Nomex layer is in contact with the applicator roll. Teflon and Nomex are trademarks of E.I. du Pont Co. of Wilmington, Del. The construction of an oil wick 4 is well known in the art. Above the oil ports 2 are movable elastomer blocks or oil port blocks 9 which are mounted on the bottom of a plunger bar 7 and cam follower 7'. The up and down movement of the plunger bar 7 is governed by the rotation of the cam shaft assembly 6 and cam 20. The cam shaft assembly 6 has multiple identical cam elements 20 which are equally located near the front end and the rear end of the oil tank 3. Each cam element 20 has the same off-center profile that determines the gap of the flow channel at different rotation angle of the cam shaft 6. Cam 20 has a tear drop profile with a projection 21. When projection 21 is in an upper position (as in FIG. 1) the oil port 2 is open. When cam projection 21 is in a lower or closed or home position (FIG. 2), the oil port 2 is closed by oil port blocks 9. FIG. 1 shows the cam shaft at the fully open position. FIG. 2 shows the cam shaft 6 and cam 20 in the closed port or home position.

The applicator roll is driven independently by a motor or by a drive chain 22 engaged with the drive mechanism 10 of a host engine (not shown in the Figures). FIG. 3 shows a side view of the oil dispensing unit 1 indicating the rotational engagement of the cam shaft 6 with a wrap-spring clutch 11 whose input hub is rotated with the applicator roll 5. The wrap-spring clutch 11 has the one-way feature allowing rotation only in one direction and its practice is well known in the art. When the input hub 10 is rotated with the applicator roll 5, the internal spring wraps down and engages the input to the output hub 12 which is engaged with the cam shaft 6. The cam shaft 6 is spring loaded and biased toward the home position (as shown in FIG. 2). When the applicator roll 5 is stopped, the internal spring unwraps allowing the cam shaft 6 to return to the home position. Furthermore, the clutch 11 can be used with different stop limits which can be set by a dial feature (not shown). With the dial feature the clearance of the flow channel gap 13 can be adjusted mechanically for providing different rate. FIG. 3 also shows the structure of the plunger bar 7. The plunger bar 7 has closed loops at both ends functioning as cam followers 7' that are integrated with the rigid open support at the center. The open space is for oil 8 volume which extends to the flow channel gap 13. Attached to the bottom of the plunger bar 7 are elastomer blocks or port blocking components 9 for covering and sealing the oil ports 2 when the cam shaft 6 is at the closed or the home position. These oil ports 2 are distributed along the bottom of the oil tank or housing 3 to allow the oil 8 being fed by gravity into the wick 4.

In practice, an oil dispensing unit 1 of the present invention is placed in the paper path of a printer (not shown) with the applicator roll 5 in contact with the print sheet 14 on the side to be applied with oil 8. The applicator roll 5 is either driven by a motor or connected to the drive system 10 of the host printer. Upon rotation of the applicator roll 5, the wrap-spring clutch 11 is activated such that the cam shaft 6 and cam 20 are rotated against a spring force to the predetermined stop limit which is mechanically set by a built-in dial. The cam rotation opens the oil ports 2 and sets the clearance of the flow channel gap 13 that determines the oil rate into the wick 4. The wick 4 dispenses oil film to the applicator roll 5 that deposits the oil 8 to the print sheet 14. The system maintains constant applicator roll speed and the oil rate is adjusted by the flow gap, if needed. When the host machine drive or the motor stops, the cam shaft 6 and cam 20 returns to the home position by the spring force and closes the oil ports 2.

Figure 4:
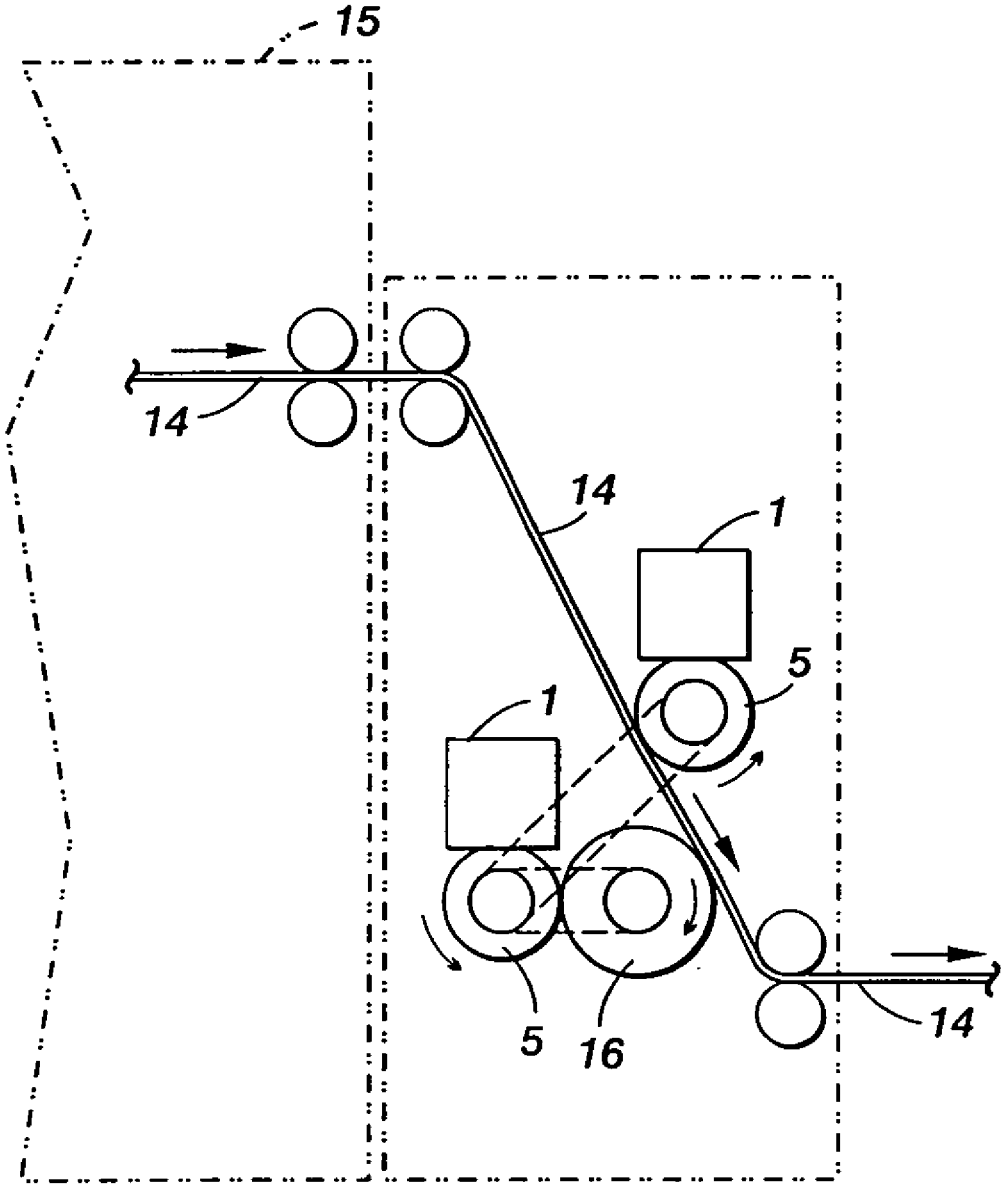
FIG. 4 illustrates a duplex oil dispenser system for a duplex continuous feed machine.
Figure 5:
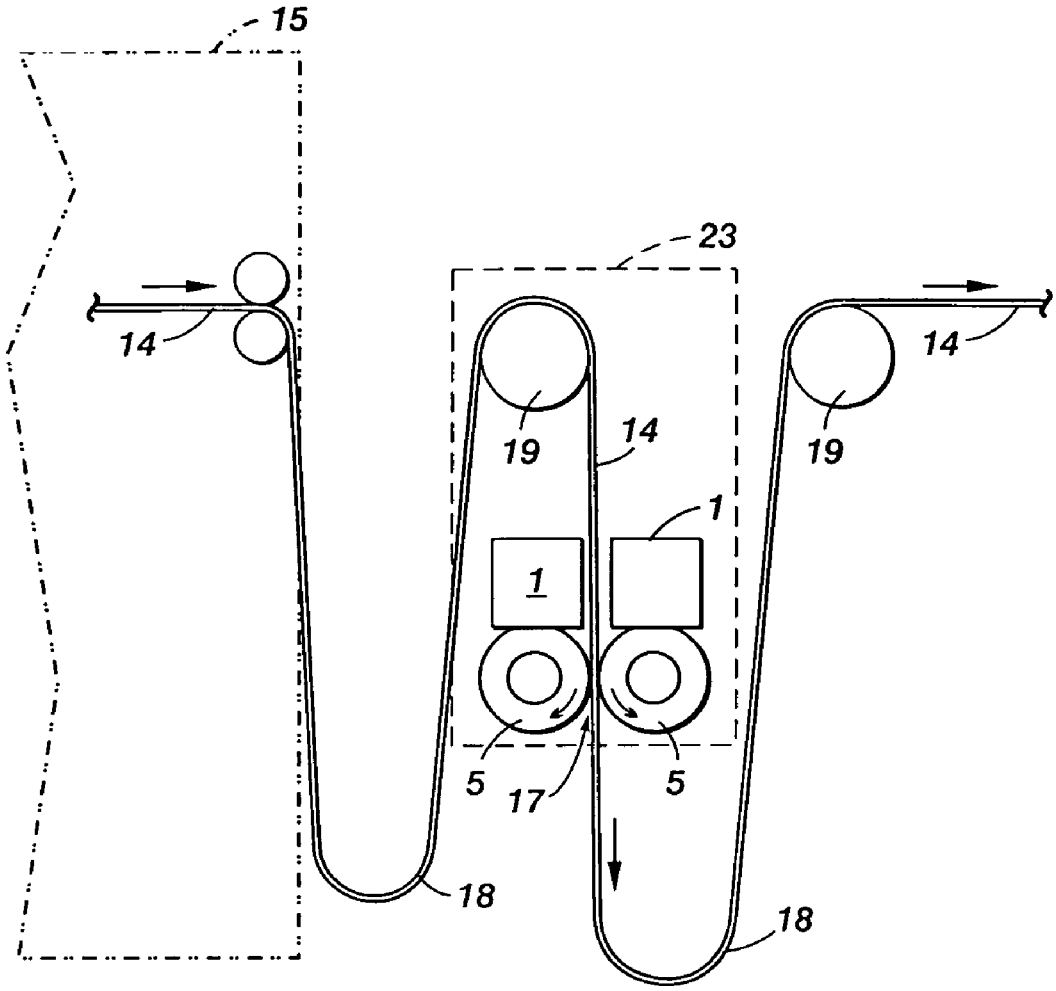
FIG. 5 illustrates a duplex oil dispenser with a drive nip.
Figure 6:
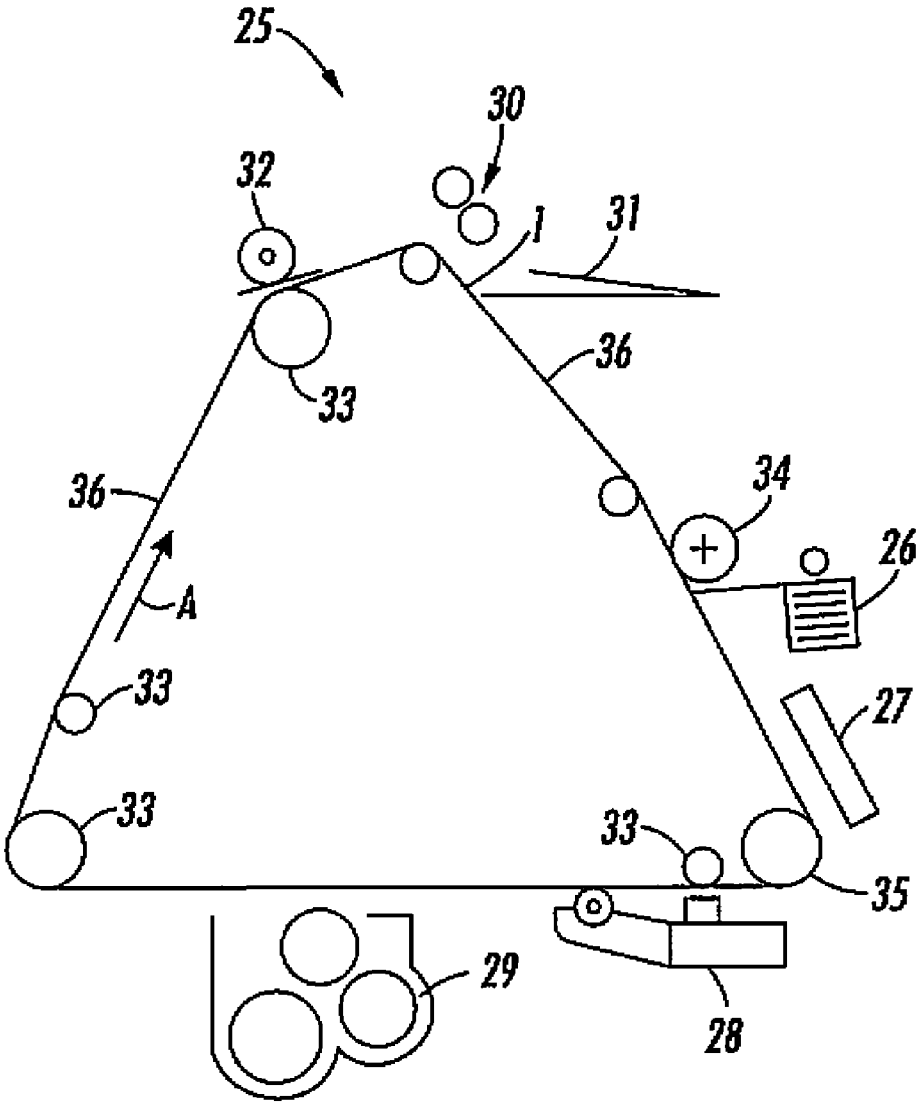
FIG. 6 illustrates a known electrophotographic or xerographic marking process with the location of the oil dispenser system of this invention indicated.

In one embodiment for simultaneous duplex printing application, two oil dispensing units 1, are described, where one oil dispensing unit 1 can be integrated with an oil transfer roll 16 for applying oil 8 to a second side (side 2) of a print sheet and sheet transport 14. Another application roll 5 can apply oil 8 to the first side (side 1) of a print sheet 14. FIG. 4 shows a configuration of a duplex oil dispenser for duplex oiling. As an example, the dual oil dispenser as shown is mounted at the exit of a flash fusing duplex printer 15. The oil transfer roll 16 is the drive source of the duplex oil dispenser as it drives the applicator rolls 5 of the two oil dispensing units for actuating the cam shafts 6 for dispensing oil 8. The oil transfer roll 16 is connected to the machine drive of the host engine or optionally driven by an independent motor for running at the sheet speed. Another embodiment is for two applicators in a duplex oil dispenser 23 forming a drive nip 17 as shown in FIG. 5 in which two oil dispensing units 1 are positioned side by side at upright position. In such configuration, the nip force may be designed to flatten flash fused toner images and enhance the fix level. For accommodating potential speed mis-match between drive nips 17 of the oil dispenser 1 and the host engine, and between drive nips 17 of the oil dispenser 1 and the finisher, paper loops 18 are created for avoiding tensioning of the sheet 14 in the paper path. Turn rolls 19 direct and transport paper print sheet 14. In all of the above-described applications, an applicator roll 5 may have rigid metal or rubber surfaces. As earlier noted, any suitable provisions can be made to retrofit the unit of this invention in any existing marking apparatus, such as the existing electrophotographic marking apparatus shown in FIG. 6. In FIG. 6, a known electrophotographic marking apparatus 25 is shown having: a paper feed 26, a charging station 27, an exposure station 28, a developer or marking station 29, a fusing station 30 and a collection station or a finishing station 31; a transfer charger 32, rollers 33, a cleaning station 34, a motor 35 and a photoconductor belt 36. The oil-dispensing system 1 of this invention is located or positioned after said fusing station 30 and before said finishing station 31 as indicated by location 1.

In summary, in an embodiment an oil dispensing system is used for distributing oil to an applicator roll in an image forming apparatus comprising in an operative arrangement a unit comprising an oil tank housing enabled to hold an oil supply, oil ports or openings positioned in a bottom section of the housing, a port and an assembly for controlling the movement of said component to thereby open and close the ports and whereby opening and closing of the oil ports is controlled by a cam shaft movement activated by a rotation and stopping of the applicator roll. This system comprises a wick positioned between said applicator roll and said ports and whereby an open port is enabled to distribute oil to an adjacent wick which is in contact with the applicator roll. In this system, at least one of the oil dispensing units is positioned in the image forming apparatus. This system has any suitable provisions for being retrofitted into any existing flash fusing continuous feed apparatus. The unit is enabled to dispense oil to one surface of a printed sheet. Also, in a duplex mode, the unit is enabled to dispense oil to both surfaces of a printed media sheet.

A retrofit can be made in an electrophotographic marking system using the unit of this invention. This unit comprises in an operative arrangement a printed media and at least two applicator rolls and units comprising at least two oil tank housings with ports using at least two mechanical cam oil flow controls. It has an applicator roll in contact with each of said housings and a wick positioned between each of said housing ports and said applicator rolls. The oil ports are located at bottom portions of each of the housing with movable blocks located adjacent each of the ports. The blocks are positioned by controls to either open or close the ports to dispense oil therefrom or to prevent the flow of oil therethrough. These controls are regulated by a cam shaft movement which is activated by a movement of the applicator roll. This system is enabled to dispense oil to both sides of the sheets to provide thereby duplex oil dispensers wherein the cam has a cam projection which when rotated in a home position will be enabled to cause an oil port block to block the oil port. The cam projection, when rotated in an open position, will be enabled to cause an oil port block to open the oil port to allow oil to flow therethrough to the wick. The at least two units are each located adjacent opposite sides or surfaces of the sheets and enabled to thereby dispense oil to both sides of the sheets.

The duplex oil dispenser of this invention comprises an oil housing adjacent a first applicator roll, and an oil housing adjacent to a second applicator roll. The first applicator roll is enabled to dispense oil to a first side of the printed media and the second applicator is enabled to dispense oil to a second side of the printed media. This system is used whereby a duplex oil dispenser is used having two applicator rolls side by side adjacent each other with each having oil dispensing units in contact therewith. The transport is enabled to pass said printed media between a nip formed in the side by side applicators. This system is used whereby said duplex oil dispenser comprises an oil housing adjacent a first applicator roll in the system, and an oil housing adjacent to a second applicator roll located subsequently to the first applicator roll in the system. The first applicator roll is enabled to dispense oil to a first side of the printed media and the second applicator is enabled to dispense oil to a second side of the printed media.

It will be appreciated that various of the above-disclosed and other features and functions, or alternatives thereof, may be desirably combined into many other different systems or applications. Various presently unforeseen or unanticipated alternatives, modifications, variations or improvements therein may be subsequently made by those skilled in the art which are also intended to be encompassed by the following claims.

What is claimed is:

1. An electrophotographic marking apparatus comprising:

a fusing station, a finishing or collection station, and an oil dispensing system that is configured to be positioned after said fusing station but before said finishing station, said oil dispensing system configured to directly dispense oil to a printed sheet to be treated or media having thereon a fused toned image, said oil configured to increase the fix performance of said fusing station before said printed sheet enters said finishing station, said oil dispensing system comprising a unit comprising a cam and cam shaft, an oil tank housing, a mechanical cam oil flow controlling component within said housing with a wick enabled to dispense oil directly to an applicator roll, said applicator roll configured to directly contact said sheet to be treated, said wick located at a bottom portion of said oil tank housing below at least one oil port and above said applicator roll, said at least one oil port distributed along a width and length of said wick, a plunger bar having oil port blocks mounted thereon, said plunger bar configured to have an up and down movement, said up and down movement of said plunger bar and said cam is governed by a rotation of said cam shaft and said cam, said applicator roll configured to apply oil to at least one surface of said printed sheet, said controlling component having said cam which has a tear drop profile and configured when in an upper position to open said ports to dispense oil therefrom and configured when in a lower position to close said ports by said oil port blocks to prevent the flow of oil therethrough, said cam configured when rotated to contact said oil port block when in said lower position to thereby block said oil port and flow of oil therefrom.

2. An oil dispensing unit configured to distribute oil to a printed sheet in an electrophotographic marking process, said unit located in said electrophotographic marking process, said unit comprising an oil tank housing, a mechanical cam activated oil flow controlling component positioned within said housing, a wick located in a lower section of said housing configured to disperse oil directly to an applicator roll, and oil ports located in a bottom portion of said housing, said oil ports distributed along a width and length of said wick, said controlling component comprising a cam shaft and a tear drop cam structure configured to open said ports to dispense oil therefrom, said cam when in an upper position and configured to close said ports when said cam is in a lower position to prevent via oil port blocks the flow of oil therethrough, said flow controlling component is regulated by said cam shaft and cam movement actuated by rotation and stopping of said applicator roll, whereby said ports are located above said wick at a bottom portion of said housing, and said wick is operatively positioned between said ports and said applicator roll, and whereby an open port is configured to distribute oil directly to said adjacent wick and said applicator roll when said wick is in contact with said applicator roll.

3. The unit of claim 2 whereby said unit is enabled to dispense oil to one surface of a marked receiving sheet.

4. The unit of claim 2 whereby said unit is enabled to dispense oil to both surfaces of a marked receiving sheet.

5. The unit of claim 2 whereby at least one of said oil dispensing units is positioned in an image forming apparatus.

6. The unit of claim 2 having provisions for being retrofitted between a fusing station and a finisher or collection station into any existing flash fusing continuous feed apparatus.

7. The unit of claim 2 whereby said unit is enabled to dispense oil to one surface of a printed media sheet.

8. The unit of claim 2 whereby said unit is enabled to dispense oil to both surfaces of a printed media sheet.

* * * * *